United States Patent [19]

van Deursen

[11] 4,456,020

[45] Jun. 26, 1984

[54] ADJUSTABLE HAIR CURLER

[75] Inventor: Gary E. van Deursen, Upper Saddle River, N.J.

[73] Assignee: General Electric Company, New York, N.Y.

[21] Appl. No.: 563,091

[22] Filed: Dec. 19, 1983

[51] Int. Cl.[3] ..... A45D 2/00

[52] U.S. Cl. ..... 132/34 C; 132/40

[58] Field of Search ..... 132/34, 40, 42, 35

[56] References Cited

U.S. PATENT DOCUMENTS

| | | | |
|---|---|---|---|
| 56,531 | 7/1866 | Cook . | |
| 720,169 | 2/1903 | Mills . | |
| 1,115,057 | 10/1914 | Delaney . | |
| 2,335,179 | 11/1943 | Feller . | |
| 2,557,510 | 6/1951 | Nau-Touron . | |
| 2,781,047 | 2/1957 | Whitehill | 132/40 |
| 3,105,503 | 10/1963 | Safianoff | 132/40 |
| 3,123,079 | 3/1964 | Buesgen | 132/40 |
| 3,326,495 | 6/1967 | De Bruyn . | |
| 3,623,491 | 11/1971 | Garrett . | |
| 3,683,940 | 8/1972 | Debue . | |
| 3,712,310 | 1/1973 | Parlagreco | 132/40 |
| 4,141,370 | 2/1979 | Haas . | |

*Primary Examiner*—Gregory E. McNeill

*Attorney, Agent, or Firm*—John F. Cullen; George R. Powers; Leonard J. Platt

[57] ABSTRACT

The invention relates to an adjustable hair curler of general spool or roller shape with a pair of telescoping elongated tubes axially and rotatably movable relative to one another. A pair of nested larger diameter end caps is secured at each end of each tube with the roller generally resembling a spool. Each pair of caps includes a first cap with plural spiralled cam slots radiating from its center and a second cap nested in the first with a plurality of corresponding or equal number of straight cam slots radiating from its center. The nesting caps are rotatable relative to each other and the caps at each end are connected together by a plurality of toothed elongated curler segments. Each segment has structure at each end cooperating with the cap slots such that by rotating the end caps in opposite directions the segments are radially cammed to change the curler roller diameter. Additional structure locks the cap rotation at any desired roller diameter. All the components are molded plastic except the inner elongated tube is aluminum to absorb heat as a central thermal mass for curling hair on the curler roller.

7 Claims, 8 Drawing Figures

ADJUSTABLE HAIR CURLER

BACKGROUND OF THE INVENTION

1. Field of the Invention

The invention is an adjustable hair curler roller as supplied with known hair setters which roller can be adjusted to many diameters from small to large. This is accomplished by rotating end caps of the rollers in opposite directions to expand or contract the position of elongated curler segments so an adjustable diameter hair curler is provided.

2. Description of the Prior Art

In many well known hair setters of an enclosed box-shaped housing there is provided a multiplicity of rollers, such as toothed hard plastic or soft foam-covered, or different sized roller curlers and all are generally supported for heating to make various sized curls. Generally, the rollers are used individually and are placed on a suitable support within the box to be saturated with steam or just heated and then removed and used to roll hair. Both hard and soft roller arrangements are known and have been used for many years. Since the hair setters generally include many rollers of different size for maximum flexibility, it has been known to use adjustable diameter rollers in order to reduce the number required with a given hair setter. Typical such rollers are shown in U.S. Pat. Nos. 3,623,491; 3,683,940; and 4,141,370. Additionally, adjustable rollers or cylinders are known in the general mandrel art as in U.S. Pat. Nos. 720,169; 2,557,510; and 2,762,577. Thus, both expandable rollers generally as well as hair curler rollers specifically are known in the prior art. Usually, such rollers as used for curlers, have been flimsy plastic tubes that are hard to handle, adjust, heat, and disassemble after the curling operation.

An object of the present invention is to provide an adjustable hair curler that is sturdily constructed, lends itself to molded plastic parts, has considerable consumer appeal, has fixed adjustability, and is easily manipulated by the user all to considerably reduce the many different-sized rollers or curlers in a hairsetter.

An object of the invention is to provide an adjustable hair curler roller that permits user selection of multiple roller diameters from small to large by a simple twisting motion.

Another object is to provide an adjustable hair curler roller with adjustability to replace many rollers and thus provide flexibility and fewer components in a common hair setter.

A final object is to provide an adjustable hair curler roller of specific construction that is an improvement on present rollers, has wide consumer appeal, is easy to use, economical to manufacture, and can be locked in numerous diameters by the user.

SUMMARY OF THE INVENTION

Briefly described, the invention is directed to an adjustable hair curler roller of general spool-shape comprising a pair of telescoping elongated tubes axially and rotatably movable therebetween. At the end of the tubes there is provided a pair of nested larger diameter end caps secured at each end of each tube. Each pair includes a first cap having a plurality of spiralled cam slots radiating from the center thereof and a second nesting cap having a plurality of corresponding in number straight cam slots radiating from the center so the nesting caps are rotatable relative to each other. Connected and extending between the caps along the tubes is a plurality of toothed elongated curler segments and each segment has means at each end cooperating with all of the slots and with interconnected structure such that, on rotation of each first cap relative to the second, the segments are radially cammed to change the roller diameter. Additionally, the tubes and all end caps may conveniently be cylindrical and the segments may have stop means on their ends cooperating with the caps to ensure radial movement only so the cylindrical periphery of the segments is maintained in all cammed positions. For locking, cooperating intermeshing arcuate gear sections are provided between nesting caps with a biasing means disposed so the caps are longitudinally pulled apart and then released to lock in any selected adjusted diameter. Thus, the main object is to provide an adjustable hair curler roller that is easily twisted to different sized selected diameters by the user and locked in position for flexibility so fewer rollers are required.

DESCRIPTION OF THE PREFERRED EMBODIMENT

Figure 1:
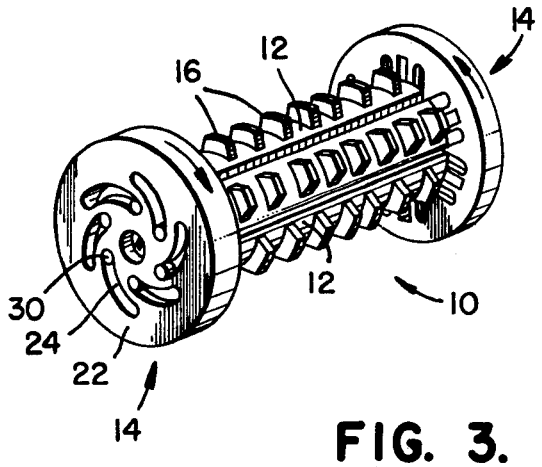
FIG. 1 is a perspective view of the curler.
Figure 2:
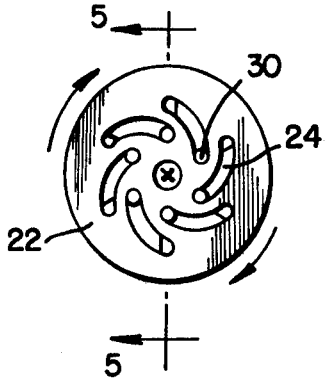
FIG. 2 is a left end view of FIG. 1.

Referring to FIG. 1 there is shown an adjustable hair curler roller 10 of central elongated plural curler segments 12 that extend between end caps 14 providing a spool-shape generally known in the hair curler art. The individual segments 12 have appropriately-shaped teeth 16 around the curler which, in turn, is heated, the hair wound around teeth 16 until set and then the curler is removed. This general concept is well known and shown in various forms on a curling iron in U.S. Pat. No. 3,459,199.

Figure 3:
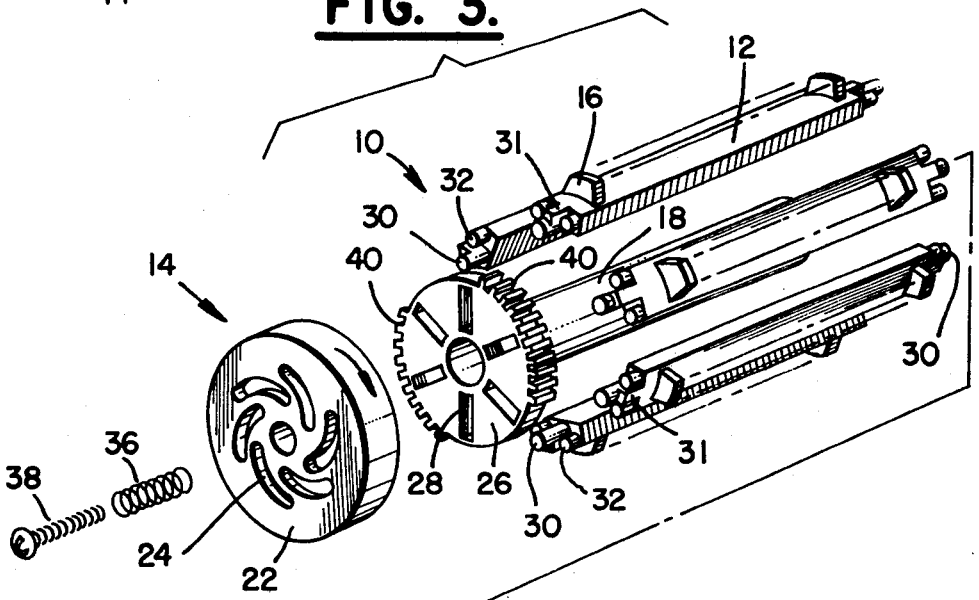
FIG. 3 is an exploded perspective view of the curler of FIG. 1.
Figure 4:
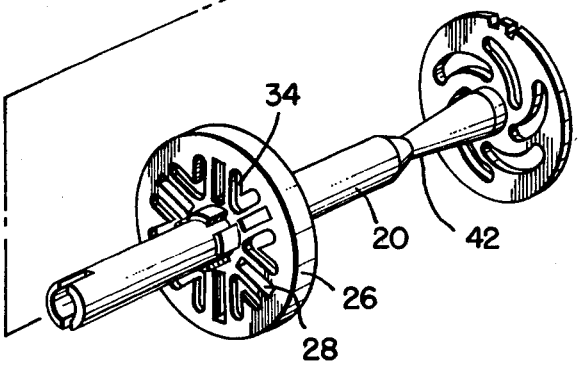
FIG. 4 is an end view, similar to FIG. 2, of the inner nesting cap.
Figure 4:
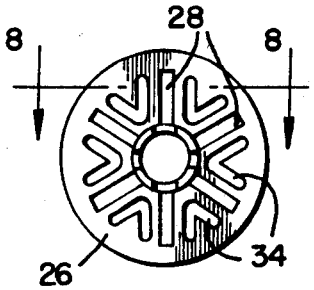
Figure 5:
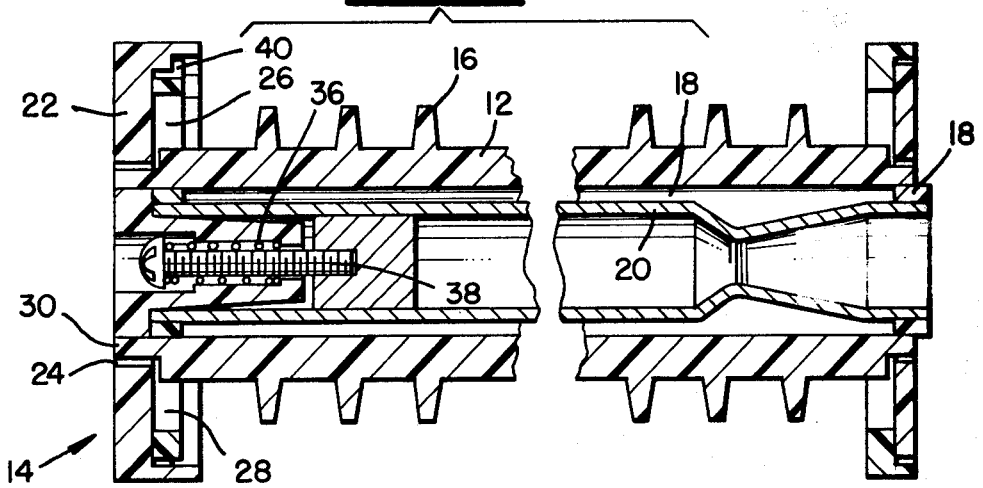
FIG. 5 is an enlarged broken sectional view of the roller on line 5—5 of FIG. 2.
Figure 6:
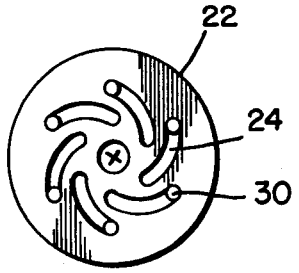
FIG. 6 is an end view like FIG. 2 of the expanded spiral position of the curler.
Figure 7:
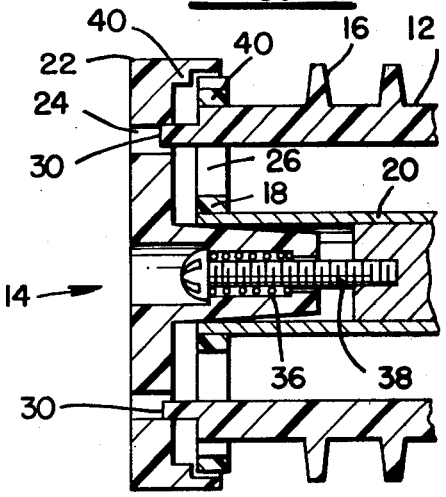
FIG. 7 is a partial sectional view of the left end of FIG. 5 with the nesting caps rotated to expand the curler diameter.
Figure 8:
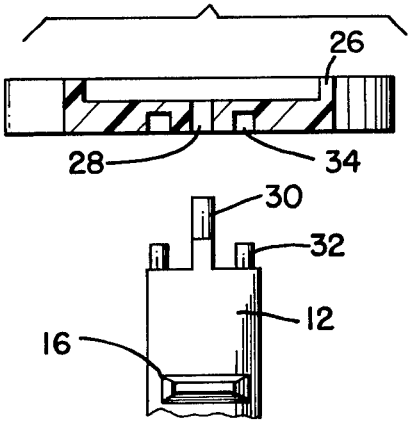
FIG. 8 is a sectional view on line 8—8 of FIG. 4 showing segment stop means.

In accordance with the invention, to provide an adjustable diameter curler easily manipulated by the user, there is provided a pair of telescoping elongated tubes of an outer tube 18 and an inner tube 20 with tube 20 inserted within outer tube 18 so that the two tubes are axially and rotatably movable relative to each other and fit together as shown exploded in FIG. 3 and in FIGS. 5 and 7. For controlling the relative movement between the tubes, there is provided a pair of nested larger diameter end caps, generally shown at 14. Each pair includes a first outer cap 22 provided with a plurality of spiralled cam slots 24 that radiate from the center of the cap that is, they radiate outwardly generally from the center. Disposed within cap 22 is a second inner nesting cap 26 which has a plurality of corresponding in number straight cam slots 28 which slots radiate directly from the center of the cap as seen in FIGS. 3 and 4. For a purpose to be explained, the nesting caps are rotatable relative to each other or in other words may be twisted with the outer cap rotating around the inner nested cap. This is the construction as shown in the left side of FIG. 3 and is substantially repeated at the right side of FIG. 1 except that the nesting arrangement is reversed with the straight slot cap circumscribing the spiral cap for a purpose that will become apparent. At any rate, the structural arrangement of nesting radial and straight slotted caps is identical for each pair and a pair of the caps is secured at each end of each tube. Thus, a pair of caps occurs at the left as seen in FIG. 1 and a similarly-functioning but alternately nested like pair occurs at the right side of FIG. 1, the overall appearance being in the form of a spool-shaped as clearly shown in FIG. 1. To provide the variable diameter or adjustable feature of the curler, there is provided a plurality, six in the embodiment shown, of elongated and suitably toothed segments 12 as shown in FIG. 1, the segments extending between the end caps and connected thereto. For the segments, which are generally suitably peripherally curved, to be movable radially, each segment is provided with the equivalent of a pivot means 30 (FIGS. 3 and 5–8). These are molded elongated projections designed to extend through straight slots 28 directly into spiral slots 24 such that, as shown in FIG. 1 with details in FIG. 3, when first cap 22 is twisted or rotated relative to its second nested cap 26, spiral slots 24 cam the projection or pivot means 30 outwardly in the straight slots to move the segments 12 radially outward enlarging the roller diameter. Rectangular portions 31 help maintain the cylindrical roller shape as the segments move. This action occurs at both ends of the roller when the user applies a twisting motion as indicated by the arrows on the opposite end caps 14 in FIG. 1. A reverse twisting reduces the radial position of segments 12 to create a small diameter roller as seen in FIGS. 1 and 5. As shown, the caps and elongated tubes are preferably cylindrical although they are not limited to a cylindrical shape.

As thus far described, the twisting motion on the end caps changes the diameter of the curler. In order to maintain the segments 12 aligned and maintain the cylindrical periphery during pure radial movement only, suitable stop means 32 like pivots 30 are provided on the ends of the segments. These are smaller projections that are guided in similar parallel radial slots 34 the arrangement being such that the combination of the projections 30 and 32 cooperate with each second or straight slotted cap so the segments have only pure radial movement and maintain a cylindrical periphery in all adjusted positions. Additionally, stops 32 prevent the hair from being caught by the edges of the segments. As described then, the segments 12 are cammed radially inward or outward to differing roller diameters by twisting the opposite pairs of end caps 14.

It is desirable to have means so the segments may be locked into a desired or selected diameter. For this, some axial relative movement of tubes 18 and 20 is desired by pulling axially on the end caps 14. To this end, a biasing means is provided in the form of spring 36 disposed around bolt 38 that connects and holds the tubes in longitudinal assembled position as shown in FIGS. 5 and 7. Spring 36 pulls inward and biases the nested end caps toward each other into the FIG. 5 position. Freedom of movement lengthwise is allowed against the bias by pulling end caps 14 longitudinally away from one another or apart to the position shown in FIG. 7 which, when released, snaps the roller back into the position of FIG. 5 under the action of spring 36. For locking the roller in any adjusted position, at least one, the left end as shown in FIG. 3, pair of nesting caps are provided with cooperating intermeshing arcuate gear sections 40 extending partially around the periphery of cap 26 as clearly seen in FIG. 3 and this is designed to mesh with a similar arcuate gear section on the inner periphery of the nesting cap 22 (unseen in FIG. 3 but shown in FIGS. 5 and 7) so that when the gears are meshed under the bias provided by spring 36 as shown in FIG. 5, there is no relative movement between the nesting caps. Thus, the segments are locked in their radially placed position or the innermost position as shown in FIG. 5. When the caps are pulled longitudinally to disengage the locking gear means and then rotated to a newly cammed diameter as shown in FIG. 7 in the largest diameter, and then released, the gear sections are pulled together into the locking position of FIG. 5 to fix the roller in a newly adjusted diameter. Of course, the space between each adjacent segment increases as the diameter increases and conversely, decreases to the most inward or smallest radial position of FIGS. 1 and 5 while maintaining the cylindrical periphery of segments 12. This causes no problem in the hair rolling function.

While the structure may appear somewhat complex from the drawings, substantially all components are of simply molded plastic so are easily and inexpensively formed. Preferably the inner elongated tube 20 is an aluminum shaft for absorbing the heat as a central thermal mass for the curler. The necked-down portion 42 is functionally for another reason—being a tapered fit to slide on a heating post in the hairsetter—and it has no particular purpose in the adjustable roller structure described.

Thus, the present adjustable roller is inexpensively formed of molded plastic and is structurally assembled to provide a simple adjustable hair curler that conveniently locks in any selected diametric position by simply pulling on end caps 14, twisting slightly to the desired diameter, releasing and allowing the bias to pull the caps together and lock the segments in a different position.

While I have hereinbefore shown a preferred form of the invention, obvious equivalent variations are possible in light of the above teachings. It is therefore to be understood that, within the scope of the appended claims, the invention may be practiced otherwise then as specifically decribed, and the claims are intended to cover such equivalent variations.

I claim:

1. An adjustable hair curler roller of general spool-shape comprising, a pair of telescoping elongated tubes axially and rotatably movable therebetween, a pair of nested larger diameter end caps secured at each end of each tube, each pair including a first cap having a plurality of spiraled cam slots radiating from the center a second nesting cap having a plurality of corresponding straight cam slots radiating from the center said nesting caps rotatable relative to each other, a plurality of toothed elongated curler segments extending between said end caps with means at each end cooperating with all said slots whereby, on rotation of each first cap relative to the second, said segments are radially cammed to change the roller diameter.

2. Apparatus as described in claim 1 wherein the elongated tubes are cylindrical and all said end caps are cylindrical.

3. Apparatus as described in claim 2 wherein said cooperating means at the segment ends includes elongated projections extending through said straight slots and into said spiral slots.

4. Apparatus as described in claim 3 wherein said segments have stop means on the ends thereof cooperating with each second cap to ensure radial movement only and maintain the cylindrical periphery of the segments in all radially cammed positions.

5. Apparatus as described in claim 4 wherein the inner and outer peripheries of at least one pair of nesting caps have cooperating intermeshing arcuate sections of gear means locking said caps against rotation.

6. Apparatus as described in claim 5 having means biasing the nested end caps toward each other whereby the caps may be pulled longitudinally to disengage said locking means and rotated to a cammed diameter, said bias engaging said gear means and locking the roller in an adjusted diameter.

7. Apparatus as described in claim 6 wherein substantially all said components are molded plastic and the inner of said elongated tubes is an aluminum shaft to absorb heat as a central thermal mass for hair on said curler.

* * * * *